US009644900B2

(12) United States Patent
Beutler et al.

(10) Patent No.: US 9,644,900 B2
(45) Date of Patent: May 9, 2017

(54) EVAPORATION HEAT TRANSFER TUBE

(71) Applicant: WIELAND-WERKE AG, Ulm (DE)

(72) Inventors: Andreas Beutler, Weissenhorn (DE); Andreas Schwitalla, Illerkirchberg (DE); Jianying Cao, Shanghai (CN); Zhong Luo, Shanghai (CN)

(73) Assignee: WIELAND-WERKE AG, Ulm (DE)

( * ) Notice: Subject to any disclaimer, the term of this patent is extended or adjusted under 35 U.S.C. 154(b) by 181 days.

(21) Appl. No.: 14/427,436

(22) PCT Filed: Nov. 6, 2013

(86) PCT No.: PCT/EP2013/003333

§ 371 (c)(1),
(2) Date: Mar. 11, 2015

(87) PCT Pub. No.: WO2014/072047

PCT Pub. Date: May 15, 2014

(65) Prior Publication Data

US 2015/0247681 A1 Sep. 3, 2015

(30) Foreign Application Priority Data

Nov. 12, 2012 (CN) ..... 2012 1 0451660
Apr. 15, 2013 (CN) ..... 2013 1 0128956

(51) Int. Cl.
*F28F 1/42* (2006.01)

(52) U.S. Cl.
CPC ..... *F28F 1/42* (2013.01); *F28F 1/422* (2013.01); *F28F 2001/428* (2013.01)

(58) Field of Classification Search
CPC ..... F28F 1/40; F28F 1/42; F28F 1/422; F28F 2001/428
See application file for complete search history.

(56) References Cited

U.S. PATENT DOCUMENTS 6,173,762 B1 * 1/2001 Ishida ..... F28F 1/42 165/133
6,786,072 B2 9/2004 Beutler et al.
(Continued)

FOREIGN PATENT DOCUMENTS

| | | |
|---|---|---|
| EP | 0 522 985 A1 | 1/1993 |
| EP | 1 223 400 A2 | 7/2002 |
| JP | 02161291 A | 6/1990 |

OTHER PUBLICATIONS

International Search Report of European Patent Office issued in International Application No. PCT/EP2013/003333 dated Feb. 27, 2014 (2 pages).

*Primary Examiner* — Davis Hwu
(74) *Attorney, Agent, or Firm* — Flynn, Thiel, Boutell & Tanis, P.C.

(57) ABSTRACT

An evaporation heat transfer tube has a tube main body and a step-like structure; outer fins are arranged at intervals on the outer surface of the tube main body and an inter-fin groove is formed between two adjacent outer fins; the step-like structure respectively abuts against the bottom plane and one of the side walls of the inter-fin groove. The step-like structure has a first surface, a second surface and at least one flange formed by the intersection of the two surfaces, wherein the first and the second surface intersect respectively with the side wall and the bottom plane.

15 Claims, 5 Drawing Sheets

(56) References Cited

U.S. PATENT DOCUMENTS

| | | | | |
|---|---|---|---|---|
| 6,913,073 | B2 | 7/2005 | Beutler et al. | |
| 7,044,211 | B2 * | 5/2006 | Insalaco | F28F 1/022 165/179 |
| 2002/0092644 | A1 | 7/2002 | Beutler et al. | |
| 2003/0024121 | A1 | 2/2003 | Beutler et al. | |
| 2003/0094272 | A1 * | 5/2003 | Brand | B21C 37/207 165/179 |

* cited by examiner

EVAPORATION HEAT TRANSFER TUBE

FIELD OF TECHNOLOGY

The invention relates to the technical field of heat transfer devices, in particularly to the technical field of evaporation heat transfer tubes, specifically to an evaporation heat transfer tube which is utilized to enhance the heat exchange performance of the flooded evaporator and the falling film evaporator.

DESCRIPTION OF RELATED ARTS

Flooded evaporators have been widely applied in chillers for refrigeration and air conditioning. Most of them are shell-and-tube heat exchangers wherein the refrigerant exchanges heat by phase change outside of the tube and the cooling medium or coolant (e.g. water) exchanges heat by flowing inside of the tube. It is necessary to utilize the enhanced heat transfer technology for the reason that the thermal resistance of the refrigerant side is the controlling part. There is a plurality of heat transfer tubes designed for the evaporation phase change process of heat transfer.

FIG. 1 to FIG. 3 show the structure of the traditional heat transfer tube applied to the flooded evaporation enhancing surface. The main mechanism is to utilize the nucleate boiling theory of the flooded evaporation. Machining is carried out to form the fins, knurlings, plain rollings on the outer surface of tube main body 5 and to form porous structures or inter-fin grooves 2 on the outer surface of the tube main body 5, thus providing nucleation sites of nucleate boiling to reinforce the evaporation heat exchange.

The structure of the traditional heat transfer tube is described as follows: outer fins 1 are distributed in a spirally elongated manner or a mutually parallel manner around the outer surface of the tube main body 5 and inter-fin grooves 2 are formed between two adjacent outer fins 1 circumferentially. Meanwhile, the rifling internal threads 3 are distributed on the inner surface of the tube main body 5, which is specifically noted in FIG. 1. Moreover, according to the prior art, in order to form the required porous surface on the evaporation tube, normally the outer fins 1 need to be grooved and rolled on the top. The bending or flat expansion of the material of the fin top is used to form coverings with small openings 4. Such top-covered inter-fin grooves 2 with openings 4 are beneficial for heat exchange through nucleate boiling. The detailed structure is noted in FIG. 2 and FIG. 3.

The parameters of the heat transfer tube for machining and manufacturing according to FIG. 1 are as follows: The tube main body 5 may be formed by copper and copper alloy, or other metals; the outside diameter of the heat transfer tube is 16 to 30 millimeter, and the wall thickness is 1 to 1.5 millimeter; extrusion is carried out with a specialized tube mill and the machining is carried out both inside and outside of the tube. The spiral outer fins 1 and the inter-fin grooves 2 between two adjacent spiral outer fins 1 are circumferentially processed on the outer surface of the tube main body 5. The axial distance P between two outer fins 1 on the outer surface of the tube is 0.4 to 0.7 mm. (P is the distance from the centre point of the fin width of one outer fin 1 to the centre point of the fin width of another adjacent outer fin 1) The width of the fins is 0.1 to 0.35 mm, and the height is 0.5 to 2 mm. Furthermore, after the machining of the heat transfer tube shown in FIG. 1, a notched groove can be formed by using the knurling knife to extrude the top material of the outer fin 1, then a relatively-sealed inter-fin groove (with the opening 4) structure can be formed by the elongation of the bottom material of the notched groove as shown in FIG. 2 and FIG. 3.

Generally, it is a necessity for the heat transfer tube to be wetted on the surface by as much refrigerant as possible; furthermore, it is a necessity for the tube surface to provide more nucleation sites (by forming notches or slits on the outer surface of the machined tube) which is beneficial for nucleate boiling. Nowadays, with the development of the refrigeration and air-conditioner industry, higher demand for heat transfer efficiency of evaporators is put forward, and nucleate boiling heat exchange is required to be realized at a lower temperature difference in heat transfer. In general, in the case of lower temperature difference in heat transfer, the type of evaporation heat exchange is convective boiling. Then the surface structure of the heat transfer tube needs to be further optimized to realize nucleate boiling with obvious bubbles.

SUMMARY OF THE INVENTION

The object of the present invention is to overcome the drawbacks of the prior arts, to provide an evaporation heat transfer tube which is ingeniously designed and concisely structured, so that the boiling coefficient between the outer surface of the tube and the liquid outside the tube is remarkably enhanced, the heat transfer in boiling is enhanced, and it's suitable to promote large-scale application.

In order to achieve the above objects, the present invention of evaporation heat transfer tube comprising a tube main body, wherein outer fins are arranged at intervals on the outer surface of said tube main body, and an inter-fin groove is formed between two adjacent outer fins, characterized in that, said evaporation heat transfer tube further comprises a step-like structure, the said step-like structure respectively abuts against the bottom plane and one of the side walls of the said inter-fin groove, and said step-like structure comprises a first surface, a second surface and at least one flange formed by the intersection of the two surfaces, wherein said first surface and said second surface are intersected with said side wall and said bottom plane respectively.

Preferably, said first surface and said side wall form a sharp corner, the radius of curvature of said sharp corner is 0 to 0.01 mm.

Preferably, said second surface and said bottom plane form a sharp corner, and the radius of curvature of said sharp corner is 0 to 0.01 mm.

Preferably, said flange is a sharp corner, the radius of curvature of said sharp corner is 0 to 0.01 mm.

Preferably, the angle formed by said first surface and said side wall is less than or equal to 90 degree; or the angle formed by said second surface and said bottom plane is less than or equal to 90 degree.

More preferably, the angle formed by said first surface and said side wall ranges from 30 degree to 70 degree; or the angle formed by said second surface and said bottom plane ranges from 30 degree to 70 degree.

Preferably, the cross-section of said step-like structure is triangular, quadrilateral, pentagonal or step-shaped.

Preferably, the height of said step-like structure is 0.15 to 0.25 mm and the width is 0.15 to 0.20 mm.

Preferably, the height Hr of said step-like structure and the height H of said inter-fin groove meet the following relation: Hr/H is greater than or equal to 0.2.

Preferably, the number of said step-like structures is greater than 2, and said step-like structures are distributed on one or both sides of said inter-fin grooves.

Preferably, said flange is formed by the intersection of said first surface and said second surface.

Preferably, said step-like structure further comprises a third surface and a fourth surface which are connected to each other; the number of said flanges is 2, and one is formed by the intersection of said first surface and said third surface and the other is formed by the intersection of said fourth surface and said second surface.

Preferably, said outer fins are distributed in a spirally elongated manner or a mutually parallel manner around the outer surface of said tube main body, wherein said inter-fin grooves are circumferentially formed around said tube main body.

Preferably, said outer fin has a laterally elongated body, wherein the top of said outer fin extends laterally to form said laterally elongated body.

Preferably, internal threads are arranged on the inner surface of said tube main body.

The beneficial effects of the present invention are as follows: the evaporation heat transfer tube of the present invention comprises a tube main body and a step-like structure; outer fins are arranged at intervals on the outer surface of said tube main body, and an inter-fin groove is formed between two adjacent outer fins; said step-like structure respectively abuts against the bottom plane and one of the side walls of the inter-fin groove; said step-like structure comprises a first surface, a second surface and at least one flange formed by the intersection of the two surfaces, wherein said first surface and said second surface are intersected with said wall and said bottom plane respectively; Thus the slit formed between the first surface and the side wall, the slit formed between the second surface and the side wall and the flange are able to make the condensate film thinner and it is beneficial to increase the nuclei at the bottom of the evaporation cavity to form a nucleation site for nucleate boiling. Nucleate boiling heat exchange is reinforced, and at the same time, heat exchange area is increased, so that the boiling heat transfer coefficient is remarkably increased at a lower temperature difference. It is ingeniously designed and concisely structured and it remarkably enhances the boiling coefficient between the outer surface of the tube and the liquid outside the tube, it remarkably reinforces the heat transfer in boiling and it is suitable for large-scale application.

DETAILED DESCRIPTION OF THE PREFERRED EMBODIMENT

In order to have a better understanding of the technical content, the present invention is further exemplified by the following detailed description of embodiments.

Figure 1:
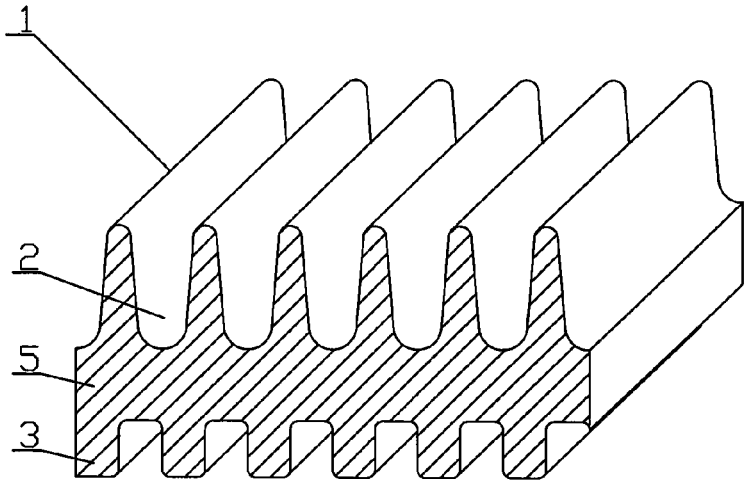
FIG 1 PRIOR ART
FIG. 1 is a cross-sectional schematic diagram in the axial direction illustrating the first embodiment of the traditional heat transfer tube with fins.
Figure 2:
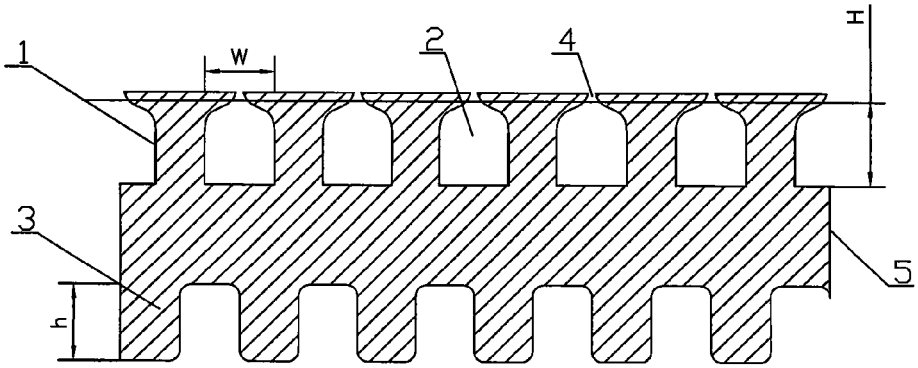
FIG 2 PRIOR ART
FIG. 2 is a cross-sectional schematic diagram in the axial direction illustrating the second embodiment of the traditional heat transfer tube with fins.
Figure 3:
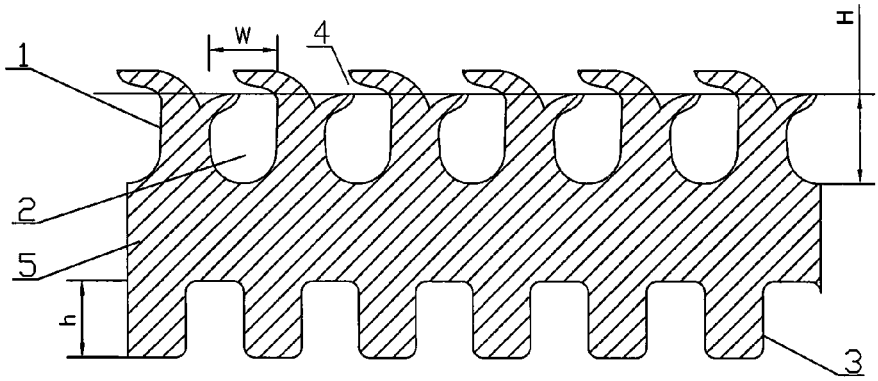
FIG 3 PRIOR ART
FIG. 3 is a cross-sectional schematic diagram in the axial direction illustrating the third embodiment of the traditional heat transfer tube with fins.

According to the mechanism of nucleate boiling, on the basis of the structure noted in FIG. 1, FIG. 2 and FIG. 3, studies have found that it is more beneficial to form the nucleation site needed for nuclear boiling if the material of one side or both sides of the bottom of the inter-fin groove 2 is extruded by mould at the base of the outer fin 1 to form the step-like structure 6 at the bottom of the inter-fin groove 2.

Figure 4:
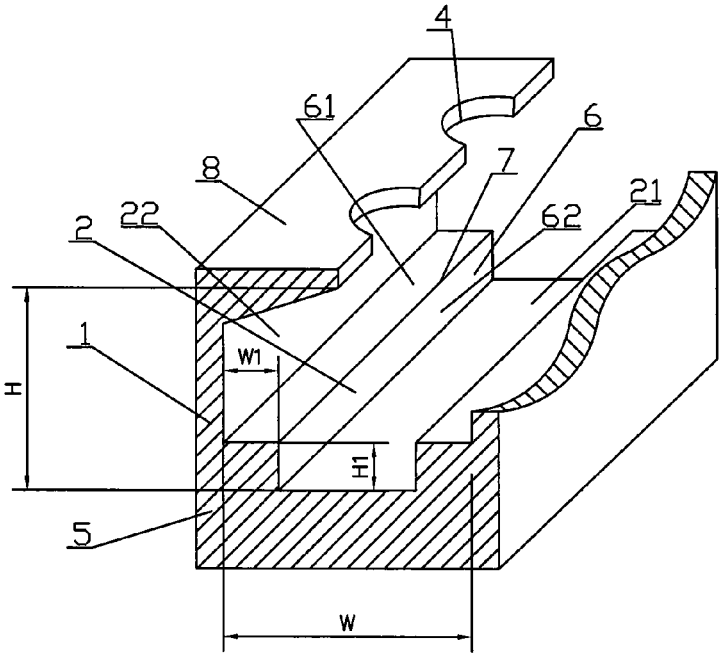
FIG. 4 is a fragmentary cross-sectional perspective view of a schematic diagram of the first embodiment according to the invention.

FIG. 4 is a perspective view schematically showing the cavity structure on the outer surface of the tube main body 5 according to the first embodiment of the present invention. As shown in FIG. 4, the step-like structure 6 is formed at the base of the outer fins 1 and abuts respectively against the bottom plane 21 and the side wall 22 of the inter-groove 2 inside the inter-fin groove 2. The step-like structures 6 can be positioned at both sides of the inter-fin groove 2 by pairs, and can be positioned simply at one side (no machining is needed on the other side) of the inter-fin groove 2, too. Said step-like structure is a monolayer. A sharp corner is formed by the first surface 61 and the side wall 22. The radius of curvature of the sharp corner is 0 to 0.01 mm, e.g. 0.005 mm. A sharp corner is also formed by the second surface 62 and the bottom plane 21. The radius of curvature of said sharp corner is 0 to 0.01 mm, e.g. 0.005 mm. Its first surface 61 and second surface 62 are intersected to form a flange 7 and the flange 7 is a sharp corner. The radius of curvature of said sharp corner is 0 to 0.01 mm, e.g. 0.005 mm. The specified radius of curvature of the sharp corner is 0 to 0.01 mm, illustrating that the position in which two planes intersect is a discontinuous transition, or non-smooth transition to forma sharp turn. The flange 7 is beneficial to reduce the thickness of the condensate film, and to increase the nucleation sites at the bottom of both sides of the cavity. Thus, the nucleate boiling heat exchange is reinforced, and the heat exchange area is increased at the same time. Thus, the boiling heat transfer coefficient is increased by more than 25% at a lower temperature difference. The axial cross-sectional structure of said step-like structure 6 is rectangular. The height H1 is 0.05-0.25 mm and the width W1 is 0.05 to 0.20 mm. Said step-like structures 6 can be distributed along the base of said outer fin 1 continuously (continuously distributed along one side or continuously distributed along both sides), or along the base of said outer fin 1 at intervals (at intervals on one side or at intervals on both sides). Referring to FIG. 4, it is distributed along both sides continuously. In a further aspect, the height Hr (namely the H1 mentioned above) of the step-like structure 6 and the height H of the inter-fin groove 2 meet the following relation: Hr/H is greater than or equal to 0.2, wherein the height H of the inter-fin groove 2 is the height of the outer fin 1 or the distance from the centre point of the opening 4 (the slit formed by the relative elongation of the laterally elongated body 8 of the neighboring outer fins 1) on the top of the inter-fin groove 2 and the bottom of the inter-fin groove 2 (when the top of the inter-fin groove 2 is covered by the elongated material).

In order to evaluate the structure influence on single tube external evaporation heat transfer by dimensions width W1 and height H1 of step-like structure 6, samples with various dimensional combinations were specially prepared for evaporation tests. The experimental conditions were as follows: refrigerant is R134a, saturation temperature is 14.4° C. and heat flux was fixed at 22000 W/m$^2$. The sample with the dimensional combination "W1=0, H1=0" (prior art) is regarded as the reference data. Percentages of the external heat transfer performance of other samples against the reference data were recorded in table 1 for comparison. As can be seen in the below table 1, when W1, H1 are both higher than 0.05 mm, the heat transfer performances are enhanced significantly, while the sample with dimensions of "H1>0.25 mm, W1>0.20 mm" has slightly lower heat transfer performance compared to "H1=0.25, W1=0.20" sample. This is mainly owing to the fact that the step size is too close to the evaporation cavity size. In addition, two groups of stepwise structures are very close to each other which make it quite difficult for actual production. Comprehensively balancing the heat transfer enhancement and the mechanical processing convenience, the dimension combination of H1 is chosen as 0.05~0.25 mm and W1 is ranged between 0.05 mm and 0.20 mm.

| | H1/mm | | | | | | | |
|---|---|---|---|---|---|---|---|---|
| W1/mm | 0 | 0.02 | 0.05 | 0.10 | 0.15 | 0.20 | 0.25 | 0.30 |
| 0 | 100% | 93% | 97% | — | 101% | — | — | — |
| 0.02 | 93% | 85% | 85% | 89% | 97% | — | — | — |
| 0.05 | 97% | 97% | 98% | 105% | 109% | 112% | 115% | — |
| 0.10 | 100% | 102% | 104% | 126% | 128% | 128% | — | — |
| 0.15 | 105% | 92% | 115% | 120% | — | 141% | 138% | — |
| 0.20 | — | 103% | 112% | 131% | 135% | 135% | 143% | 129% |
| 0.25 | — | — | — | 130% | — | 125% | 141% | — |
| 0.30 | — | — | — | — | — | 129% | 133% | 133% |

Figure 5:
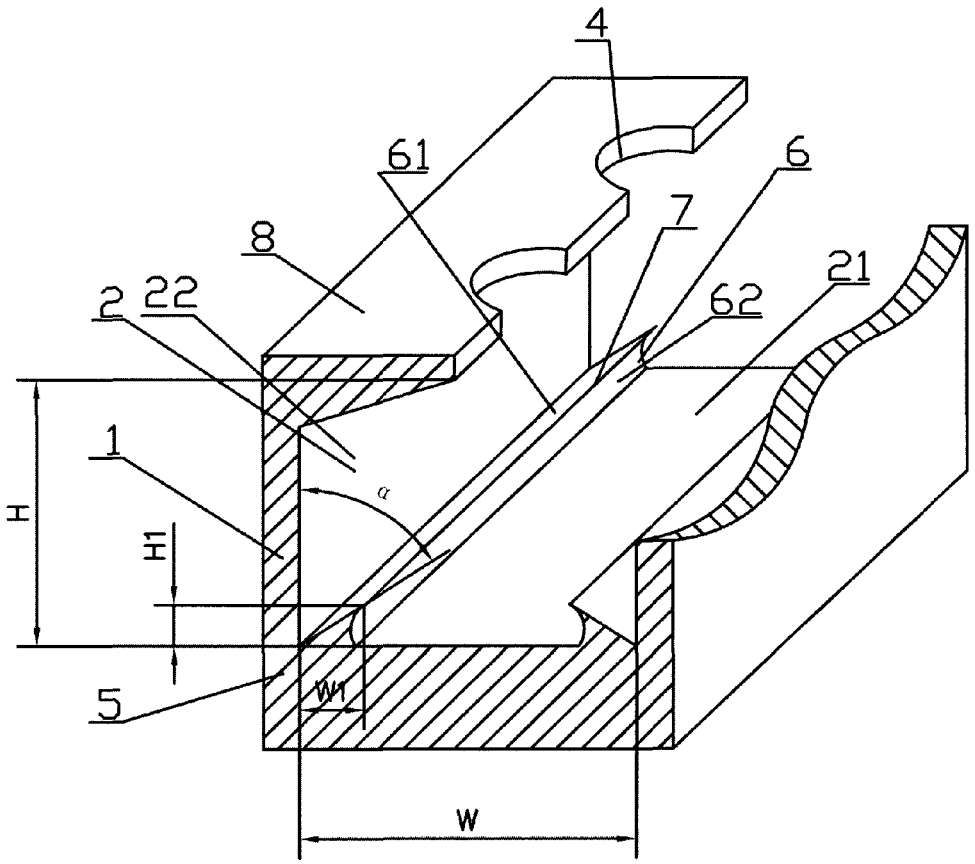
FIG. 5 is a fragmentary cross-sectional perspective view of a schematic diagram of the second embodiment according to the invention.

FIG. 5 is a perspective view schematically showing the cavity structure on the outer surface of the tube main body 5 according to the second embodiment of the present invention. As shown in FIG. 5, by extruding the material of the bottom plane 21 and the side wall 22 of the inter-fin groove 2 at the base of the outer fin 1 through a mould, a step-like structure 6 of which the cross-section is triangular is formed, and it abuts respectively against the bottom plane 21 and the side wall 22 of the inter-fin groove 2. As can be seen in FIG. 5, in some extreme circumstances, it fits the side wall 22 tightly to form simply one line. Alternatively, said step-like structure 6 can be positioned on just one side of the inter-fin groove 2 (no machining is needed on the other side) Said step-like structure 6 is a monolayer (the step-like structure here may also be formed to be bi-layer or multilayer, thus the number of the flanges will increase correspondingly.) A sharp corner is formed by the first surface 61 and the side wall 22. The radius of curvature of said sharp corner is 0 to 0.01 mm, e.g. 0.005 mm. A sharp corner is formed by the second surface 62 and the bottom plane 21 too. The radius of curvature of said sharp corner is 0 to 0.01 mm, e.g. 0.005 mm. Its first surface 61 and the second surface 62 intersect to form a flange 7. The flange 7 is beneficial to reduce the thickness the condensate film, and to increase the nucleation site at the bottom of both sides of the cavity. Thus the nucleate boiling heat exchange is reinforced, and the heat exchange area is increased at the same time. Thus the boiling heat transfer coefficient is increased by more than 25% at a lower temperature difference. The axial cross-sectional structure of said step-like structure 6 is triangular. The height is 0.05-0.25 mm and the width W1 is 0.05 to 0.20 mm. Said step-like structures 6 can be distributed along the base of said outer fin 1 continuously (distributed along one side continuously, or along both sides continuously), or along the base of the outer fin 1 at intervals (distributed on one side at intervals or distributed on two sides at intervals). Referring to FIG. 5, it is distributed along both sides continuously. In a further aspect, the angle α between the first surface 61 (the surface adjacent to the side wall 22) and the side wall 22 of said step-like structure 6 ranges from 30 degrees to 70 degrees. In a further aspect, the height Hr (namely the H1 mentioned above) of the step-like structure 6 and the height H of the inter-fin groove 2 meet the following relation: Hr/H is greater than or equal to 0.2, wherein the height H of the inter-fin groove 2 is the height of the outer fin 1 or the distance from the centre point of the opening 4 (the slit formed by the relative elongation of the laterally elongated body 8 of the neighboring outer fins 1) on the top of the inter-fin groove 2 and the bottom plane of the inter-fin groove 2 (when the top of the inter-fin groove 2 is covered by the elongated material).

Figure 6:
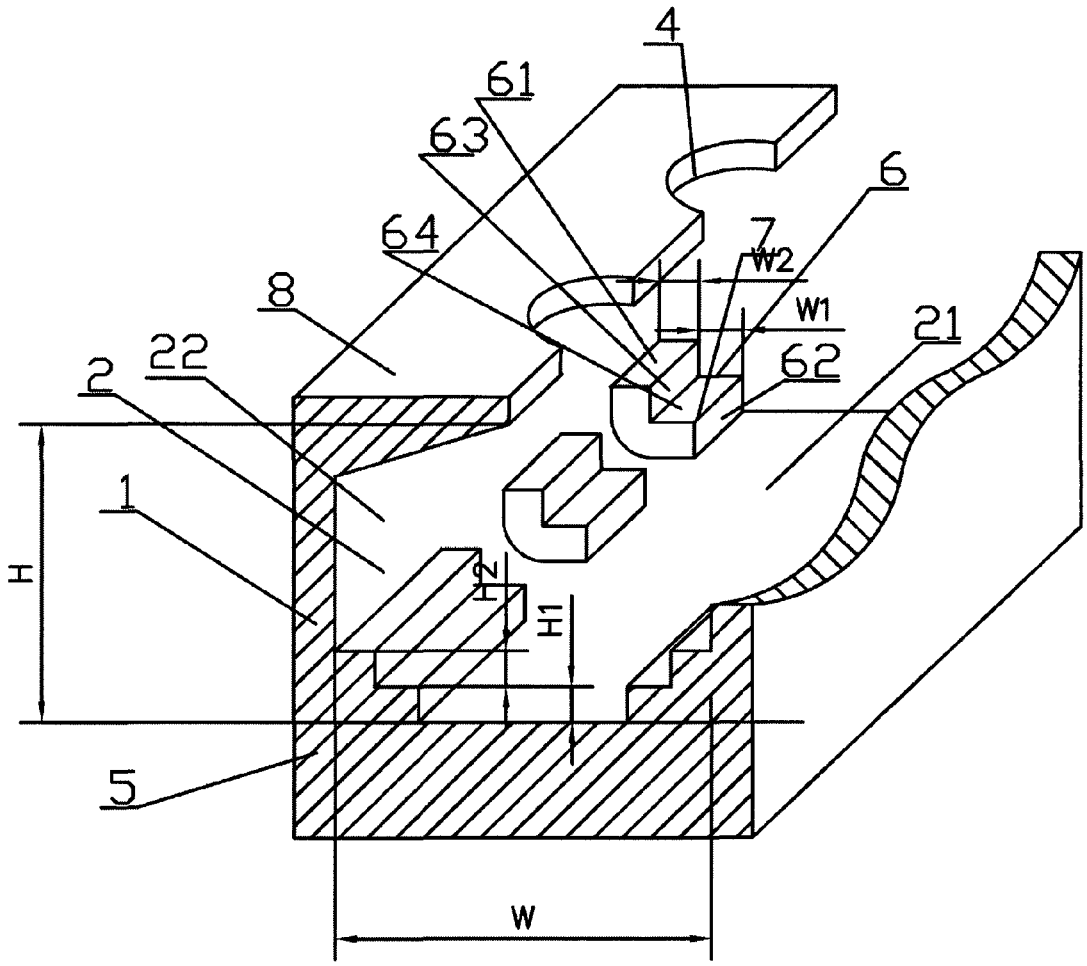
FIG. 6 is a fragmentary cross-sectional perspective view of a schematic diagram of the third embodiment according to the invention.

FIG. 6 is a perspective view schematically showing the cavity structure on the outer surface of the tube main body 5 according to the third embodiment of the present invention. As shown in FIG. 6, the step-like structure 6 is a bi-layer step-like structure (of course it can be more than two layers, e.g. three layers, four layers or more). It is formed at the base of the outer fins and it respectively abuts against the bottom plane 21 and the side wall 22 of the inter-groove 2 inside the inter-fin groove 2. The step-like structures 6 can be positioned at both sides of the inter-fin groove 2 by pairs, and also can be positioned simply at one side of the inter-fin groove 2 (no machining is needed on the other side). Said step-like structure has two step-shaped layers (at least two layers). A sharp corner is formed by the first surface 61 and the side wall 22. The radius of curvature of the sharp corner is 0 to 0.01 mm, e.g. 0.005 mm. A sharp corner is also formed by the second surface 62 and the bottom plane 21. The radius of curvature of the sharp corner is 0 to 0.01 mm, e.g. 0.005 mm. Its first surface 61 and third surface 63 intersect respectively with the fourth surface 64 and the second surface 62 form two flanges 7. The two flanges 7 are beneficial to reduce the thickness of the condensate film, to increase the degree of superheat, and to increase the nucleation site at the bottom of both sides of the cavity. Thus, the nucleate boiling heat exchange is reinforced, and the heat exchange area is increased at the same time. Thus, the evaporation heat transfer coefficient is increased by more than 25% at a lower temperature difference. The axial cross-sectional structure of every layer of said step-like structure 6 is rectangular. (of course can be rectangular noted in FIG. 5, or other regular or irregular shapes, e.g. trapezoid, pentagon and so on.) The height H1, H2 of every layer is 0.08 to 0.18 mm, and the width W1, W2 is 0.1 to 0.2 mm. Said step-like structures 6 can be distributed along the base of said outer fin 1 continuously (distributed continuously along one side or distributed continuously along both sides), or can be distributed at intervals along the base of said outer fin 1 (distributed at intervals along one side or distributed at intervals along both sides). Referring to FIG. 6, it is distributed along both sides at intervals. In a further aspect, the total height Hr (namely the H1+H2 mentioned above) of the step-like structure 6 and the height H of the inter-fin groove 2 meet the following relation: Hr/H is greater than or equal to 0.2, wherein the height H of the inter-fin groove 2 is the height of the outer fin 1 or the distance from the centre point of the opening 4 (the slit formed by the relative elongation of the laterally elongated body 8 of the neighboring outer fin 1) on the top of the inter-fin groove 2 and the bottom plane of the inter-fin groove 2 (when the top of the inter-fin groove 2 is covered by the elongated material).

According to the present invention, internal threads (not shown) can be machined on the inner surface of the tube main body 5 by using a profiled mandrel in order to reinforce the heat exchange coefficient in the tube. The higher the internal threads are, the bigger the number of the starts of the thread is, and the more capability of exchanging heat inside the tube there is, while the more fluid resistance inside the tube there is. Hence according to the third embodiment mentioned above, the height of the internal threads is all 0.36 mm; the angle between the internal thread and the axis is 46 degree; the number of the starts of the thread is 38. These internal threads are able to reduce the thickness of the boundary layer of heat transfer, thus the convective heat transfer coefficient can be increased. In a further aspect, the total heat transfer coefficient is increased.

Figure 7:
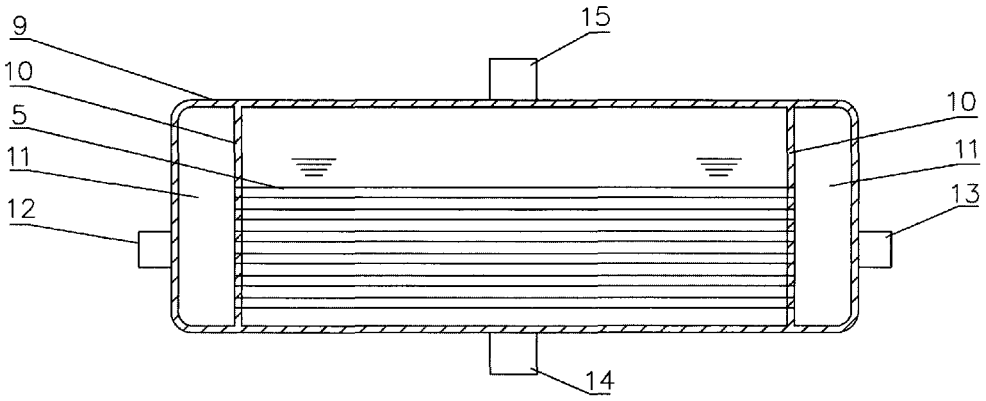
FIG. 7 is a front sectional schematic diagram of the evaporation heat transfer tube when applied in the flooded evaporator according to the invention.

The operation of the present invention in the heat exchanger is as follows:

As noted in FIG. 7, the tube main body 5 of the present invention is fixed on the tube plate 10 of the heat exchanger 9 (the evaporator). The cooling medium, (e.g. water) flows from the inlet 12 of the water chamber 11 through the tube main body 5, exchanging the heat with the outside refrigerant, then, flowing out from the outlet 13 of the water chamber 11. The refrigerant flows into the heat exchanger 9 from the inlet 14 and submerses the tube main body 5. The refrigerant is evaporated into gas by the heating of the external wall of the tube and flows out of the heat exchanger 9 from the outlet 15. The cooling medium inside the tube is cooled since the evaporation of the refrigerant is endothermic. Consequently, the boiling heat transfer coefficient is effectively increased thanks to the structure of the outer wall of the said tube main body 5 and it is beneficial to reinforce the nucleate boiling of the refrigerant.

However, on the inner wall of the tube main body 5, the internal thread structure is beneficial to increase the heat exchange coefficient inside the tube, thus to increase the overall heat exchange coefficient, consequently, to enhance the performance of the heat exchanger 9 and to reduce the consumption of the metal.

Figure 8:
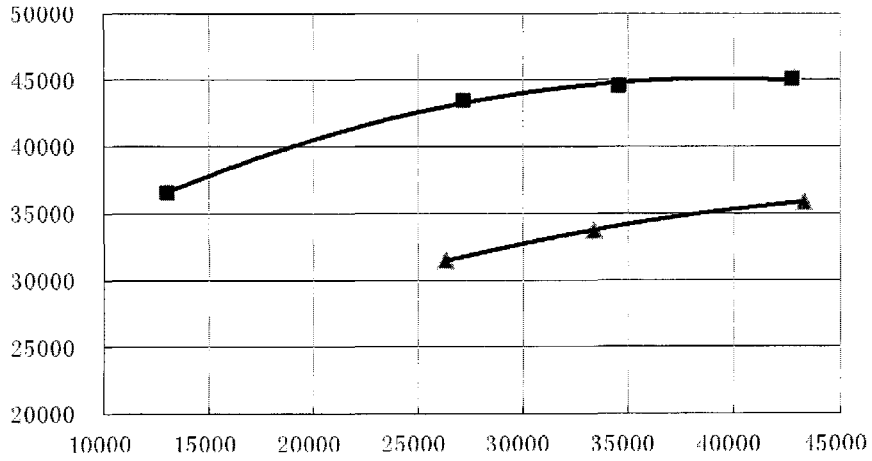
FIG. 8 is the variation graph of the evaporation heat exchange coefficient outside of the tube over heat flux, determined by experimenting with the evaporation heat transfer tube manufactured according to the present invention and the evaporation heat transfer tube manufactured according to the prior art.

Please refer to FIG. 8. A test for boiling heat transfer performance of the evaporation heat transfer tube manufactured according to the present invention is carried out. The tested evaporation heat transfer tube is manufactured according to the first embodiment. The outer fins 1 on the tube main body 5 are spiral fins. The outside diameter of the tube main body 5 with the outer fins 1 is 18.89 mm; the height H of the inter-fin groove is 0.62 mm and the width is 0.522 mm. Said step-like structure is a monolayer. A sharp corner is formed by the first surface 61 and the side wall 22. The radius of curvature of the sharp corner is 0 to 0.01 mm, e.g. 0.005 mm. A sharp corner is also formed by the second surface 62 and the bottom plane 21. The radius of curvature of the sharp corner is 0~0.01 mm, e.g. 0.005 mm. Its first surface 61 and the second surface 62 intersect to form a flange 7. The axial cross-sectional structure of said step-like structure 6 is rectangular. The height H1 is 0.2 mm and the width W1 is 0.2 mm. Said step-like structures 6 are distributed continuously along both sides of the base of said outer fin 1. The internal threads are trapezoidal thread, wherein the height h is 0.36 mm; the pitch is 1.14 mm; the angle C between the thread and the axis is 46 degree; the number of the starts of the thread is 38. In contrast, the step-like structure is not machined on the bottom plane of the inter-fin groove 2 of another heat transfer tube. As noted in FIG. 8, the result of the test shows the comparison between the boiling heat transfer coefficients outside of the tube of the evaporation heat transfer tube manufactured according to the present invention and the evaporation heat transfer tube manufactured according to the prior art. The test conditions are as follows: the refrigerant is R134a; the saturation temperature is 14.4° C.; the flow rate of the water inside the tube is 1.6 m/s. In the figure, the abscissa represents the heat flux ($W/m^2$), and ordinate represents the total heat transfer coefficient ($W/m^2K$). Solid squares represent the evaporation heat transfer tube manufactured according to the present invention, and the solid triangles represent the evaporation heat transfer tube of the prior art. Thus, it can be seen, thanks to the added step-like structure 6, its heat transfer performance has an obvious enhancement compared with the prior art.

Normally, increasing the surface roughness greatly enhances the heat flux of the nucleate boiling state. The reason is that the rough surface has a plurality of cavities to capture vapor and they provide much more and much bigger spaces for the nucleation of the bubbles. During the growth of the bubbles, a thin liquid film is formed along the inner wall of the inter-fin groove 2, and the liquid film produces a plurality of vapor by rapid evaporation.

In terms of the internal cavity of the inter-fin groove 2, the degree of superheat at the base of the fin is the maximum and the liquid is liable to evaporate. By machining the step-like structure 6 at the base of the fin, the present invention has the following advantages for evaporation heat transfer:

- Increasing the roughness of the fin base and increasing the surface area;
- Reducing the thickness of the liquid film in the cavities by forming a sharp corner by the intersection of the side wall 22 and the bottom plane 21, in a further aspect, reinforcing the boiling of the partial liquid film. Comparative test shows that if the radius of the curvature of the sharp corner is less than 0.01 mm, the heat exchange effect is increased by more than 5%, which is quite obvious.
- The slit structure formed by the step-like structures in the cavity is beneficial for increasing the nucleation sites of the nucleate boiling, thus cooperating to reinforce the boiling heat exchange of the whole cavity.

To sum up, the evaporation heat transfer tube of the present invention is ingeniously designed and concisely structured which remarkably enhances the boiling coefficient between the outer surface and the inner liquid of the tube, reinforces the heat transfer in boiling and is suitable for large-scale application.

In this specification, the present invention has been described with reference to its specific embodiments. However, it is obvious it still may be made without departing from the spirit and scope of the present invention, various modifications and transformation. Accordingly, the specification and drawings should be considered as illustrative rather than restrictive.

The invention claimed is:

1. An evaporation heat transfer tube comprising a tube main body; outer fins arranged at intervals on the outer surface of said tube main body, the outer fins having a base, and an inter-fin groove formed between two adjacent outer fins, characterized in that, said evaporation heat transfer tube further comprises a step-like structure formed at the base of the outer fins, said step-like structure respectively abuts against the bottom plane and one of the side walls of the inter-fin groove, said step-like structure comprises a first surface, a second surface and at least one flange formed by the intersection of the two surfaces, wherein said first surface and said side wall are intersected respectively with said side wall and said bottom plane.

2. An evaporation heat transfer tube according to claim 1, characterized in that said first surface and said side wall form a sharp corner, and the radius of curvature of said sharp corner is 0 to 0.01 mm.

3. An evaporation heat transfer tube according to claim 1, characterized in that said second surface and said bottom plane form a sharp corner, and the radius of curvature of said sharp corner is 0 to 0.01 mm.

4. An evaporation heat transfer tube according to claim 1, characterized in that said flange is a sharp corner, and the radius of curvature of said sharp corner is 0 to 0.01 mm.

5. An evaporation heat transfer tube according to claim 1, characterized in that an angle formed by said first surface and said side wall is less than or equal to 90 degree, or the angle formed by said second surface and said bottom plane is less than or equal to 90 degree.

6. An evaporation heat transfer tube according to claim 5, characterized in that an angle formed by said first surface and said side wall ranges from 30 degree to 70 degree, or the angle formed by said second surface and said bottom plane ranges from 30 degree to 70 degree.

7. An evaporation heat transfer tube according to claim 1, characterized in that the cross-section of said step-like structure is triangular, quadrilateral, pentagon or step-shaped.

8. An evaporation heat transfer tube according to claim 1, characterized in that the height of said step-like structure is 0.05 to 0.25 mm and the width is 0.05-0.20 mm.

9. An evaporation heat transfer tube according to claim 1, characterized in that the height Hr of said step-like structure and the height H of said inter-fin groove meet the following relation: Hr/H is greater than or equal to 0.2.

10. An evaporation heat transfer tube according to claim 1, characterized in that the number of said step-like structures is greater than 2, and they are distributed at intervals on one or both sides of said inter-fin groove.

11. An evaporation heat transfer tube according to claim 1, characterized in that said flange is formed by the intersection of said first surface and said second surface.

12. An evaporation heat transfer tube according to claim 1, characterized in that said step-like structure also comprises a third surface and a fourth surface which are connected to each other; the number of said flanges is 2, one is formed by the intersection of said first surface and said third surface, and the other is formed by the intersection of said fourth surface and said second surface.

13. An evaporation heat transfer tube according to claim 1, characterized in that said outer fins are distributed in a spirally elongated manner or a mutually parallel manner around the outer surface of said tube main body, wherein said inter-fin grooves are circumferentially formed around said tube main body.

14. An evaporation heat transfer tube according to claim 1, characterized in that said outer fin has a laterally elongated body, wherein the top of said outer fin extends laterally to form said laterally elongated body.

15. An evaporation heat transfer tube according to claim 1, characterized in that internal threads are arranged on the inner surface of said tube main body.

* * * * *